US011735832B2

(12) United States Patent
Ueda

(10) Patent No.: US 11,735,832 B2
(45) Date of Patent: Aug. 22, 2023

(54) ANTENNA MODULE AND ANTENNA DRIVING METHOD

(71) Applicant: Murata Manufacturing Co., Ltd., Nagaokakyo (JP)

(72) Inventor: Hideki Ueda, Nagaokakyo (JP)

(73) Assignee: MURATA MANUFACTURING CO., LTD., Nagaokakyo (JP)

( * ) Notice: Subject to any disclaimer, the term of this patent is extended or adjusted under 35 U.S.C. 154(b) by 0 days.

(21) Appl. No.: 17/469,915

(22) Filed: Sep. 9, 2021

(65) Prior Publication Data

US 2022/0115790 A1 Apr. 14, 2022

(30) Foreign Application Priority Data

Oct. 14, 2020 (JP) ..... 2020-173357

(51) Int. Cl.
*H01Q 21/00* (2006.01)
*H01Q 21/24* (2006.01)
*H01Q 23/00* (2006.01)

(52) U.S. Cl.
CPC ..... *H01Q 21/24* (2013.01); *H01Q 21/0006* (2013.01); *H01Q 23/00* (2013.01)

(58) Field of Classification Search
CPC .... H01Q 21/24; H01Q 21/0006; H01Q 23/00; H01Q 9/0428; H01Q 21/065
See application file for complete search history.

(56) References Cited

U.S. PATENT DOCUMENTS 6,184,828 B1 * 2/2001 Shoki ..... H01Q 3/26 342/372
9,391,375 B1 * 7/2016 Bales ..... H01Q 21/064
2020/0021015 A1 * 1/2020 Yun ..... H01Q 21/20
(Continued)

FOREIGN PATENT DOCUMENTS

CN 108134216 A 6/2018
EP 1 115 232 A2 7/2001
JP 3-151703 A 6/1991
(Continued)

OTHER PUBLICATIONS

Greda, L.A., Dreher, A.: Tx-terminal phased array for satellite communication at Ka-band. In 37th European Microwave Conference, 2007, S. 266-269.—ISBN 978-2-87487-001-9.
(Continued)

*Primary Examiner* — David E Lotter
(74) *Attorney, Agent, or Firm* — Xsensus LLP

(57) ABSTRACT

A plurality of segments each include one input-output port and a plurality of antenna ports. A plurality of subarrays each include a plurality of elements connected to any of the plurality of antenna ports. The plurality of elements constitute a sequential array for each subarray. Each of the plurality of segments includes a distribution-combination circuit that distributes a signal input to a first port to the plurality of antenna ports and that combines signals input to the respective plurality of antenna ports to output a combined signal from the first port, and a first amplifier connected between the input-output port and the first port. In the plurality of subarrays, the plurality of antenna ports to which the respective plurality of elements included in one subarray are connected are included in one segment.

20 Claims, 17 Drawing Sheets

(56) References Cited

U.S. PATENT DOCUMENTS

| | | | | |
|---|---|---|---|---|
| 2020/0335880 | A1* | 10/2020 | Sano | H01Q 1/1264 |
| 2021/0005977 | A1* | 1/2021 | Franson | H01Q 1/38 |

FOREIGN PATENT DOCUMENTS

| | | | |
|---|---|---|---|
| JP | 6-140835 | A | 5/1994 |
| JP | 2001-136024 | A | 5/2001 |
| JP | 2006-258762 | A | 9/2006 |
| JP | 2015-207799 | A | 11/2015 |
| JP | 5924959 | B2 | 5/2016 |
| JP | 2017-175282 | A | 9/2017 |
| JP | 2018-514111 | A | 5/2018 |
| JP | 2020-518149 | A | 6/2020 |
| WO | 2011/145264 | A1 | 11/2011 |
| WO | 2019/116970 | A1 | 6/2019 |

OTHER PUBLICATIONS

Analog Devices: ADPA7007CHIP Data Sheet—GaAs, pHEMT, MMIC, 1 W Power Amplifier, 18 GHz to 44 GHz. Rev. 0, Jul. 2020. S. 1-25.—Firmenschrift, URL: https://www.analog.com/media/en/technical-documentation/data- sheets/adpa7007.pdf [abgerufen am Sep. 6, 2022 ].

Kurniawan F. [et al.]: Circularly Polarized Array Antenna Using the Sequential Rotation Network Feeding for X-Band Communication. In: Progress in Electromagnetics Research C, vol. 94, 2019. S. 203-217.—DOI: 10.2528/PIERC19051703.

Moubadir M. [et al.): A new circular polarization dual feed microstrip square patch antenna using branch coupler feeds for WLAN/HIPERLAN applications. In: Procedia Manufacturing 32, 2019. S. 702-709.—DOI: https://doi.org/10.1016/j.promfg.2019.02.27 4.

German Office Action dated Jun. 9, 2022, in corresponding German Application No. 10 2021 211 569.1.

Japanese Office Action dated Apr. 4, 2023, in corresponding Japanese Patent Application No. 2020-173357.

Japanese Office Action dated Jul. 11, 2023, in corresponding Japanese Patent Application 2020-173357, 12pp.

* cited by examiner

SECOND PRACTICAL EXAMPLE

COMPARATIVE EXAMPLE

ANTENNA MODULE AND ANTENNA DRIVING METHOD

CROSS-REFERENCE TO RELATED APPLICATION

The present application claims priority to Japanese Patent application 2020-173357, filed Oct. 14, 2020, the entire contents of which being incorporated herein by reference.

BACKGROUND

1. Field

The present disclosure relates to an antenna module and an antenna driving method.

2. Description of the Related Art

As an antenna that can improve an axial ratio of a circularly polarized wave, there is a sequential array antenna including a plurality of circularly polarized antenna elements (for example, see Japanese Unexamined Patent Application Publication No. 3-151703). The sequential array antenna includes a plurality of circularly polarized antenna elements that are arranged with each rotated by any angle about a main radiation direction as an axis of rotation, and each circularly polarized antenna element is excited with a phase difference corresponding to a rotation angle.

A sequential array antenna disclosed in Japanese Unexamined Patent Application Publication No. 3-151703 is constituted by a plurality of sequential subarrays, and each of the sequential subarrays includes a plurality of circularly polarized antenna elements. A plurality of circularly polarized antenna elements included in one sequential subarray are sequenced, and a plurality of sequential subarrays are further sequenced. As an example, for one sequential subarray, reference axes of four circularly polarized antenna elements are sequentially rotated by 45° with respect to each adjacent reference axis. The use of such a configuration can provide a favorable axial ratio even if there are variations in characteristics of individual circularly polarized antenna elements or even if excitation phases or amplitudes have an error.

SUMMARY

In some communication distances or communication rates (bit rates), all circularly polarized antenna elements do not necessarily have to be used. In the case where some circularly polarized antenna elements are used, it is desired that a favorable axial ratio is maintained and that power consumption is reduced. The present disclosure provides an antenna module and an antenna driving method that, when some of a plurality of circularly polarized antenna elements are used, enable maintenance of a favorable axial ratio and a reduction in power consumption.

An aspect of the present disclosure provides an antenna module including

- a plurality of segments each including one input-output port and a plurality of antenna ports and each configured to amplify a radio-frequency signal; and
- a plurality of subarray antennas each including a plurality of circularly polarized antenna elements.

In the antenna module,

- each of the plurality of circularly polarized antenna elements is connected to any of the plurality of antenna ports,
- the plurality of circularly polarized antenna elements included in each of the plurality of subarray antennas constitutes a sequential array for each subarray antenna,
- each of the plurality of segments includes
  - a distribution-combination circuit configured to distribute a signal that is input to a first port to the plurality of antenna ports and configured to combine signals input to the respective plurality of antenna ports so as to output a combined signal from the first port, and
  - a first amplifier connected between the one input-output port and the first port, and
- in any one subarray antenna of the plurality of subarray antennas, the plurality of antenna ports to which the respective plurality of circularly polarized antenna elements included in one subarray antenna are connected are included in one segment.

Another aspect of the present disclosure provides an antenna driving method including, in an antenna module configured to cause M circularly polarized antenna elements to operate with a plurality of first amplifiers, selecting m circularly polarized antenna elements smaller in number than M and causing the m circularly polarized antenna elements to operate as an active element.

In the antenna driving method,

- any one of the plurality of first amplifiers causes, among the M number of circularly polarized antenna elements, a plurality of circularly polarized antenna elements to operate,
- the M number of circularly polarized antenna elements constitute a plurality of sequential arrays, and
- in order that the following conditions be satisfied: selected of the m circularly polarized antenna elements constitute one or a plurality of sequential arrays, and a number of first amplifiers that cause m circularly polarized antenna elements to operate is a minimum, m circularly polarized antenna elements are selected from among the M number of circularly polarized antenna elements, and the selected m circularly polarized antenna elements are used.

To cause all circularly polarized antenna elements of one subarray antenna to operate, one segment only has to be used. A sequential array is constituted by all circularly polarized antenna elements of one subarray antenna, thus enabling maintenance of a favorable axial ratio even when one segment is used. Furthermore, among a plurality of subarray antennas each constituting a sequential array, the number of segments necessary to cause only some subarray antennas to operate is not more than the number of the subarray antennas used. More segments than the number of subarray antennas used do not have to be used, thus enabling a reduction in power consumption.

Other features, elements, characteristics, and advantages of the present disclosure will become more apparent from the following detailed description of embodiments of the present disclosure with reference to the attached drawings.

DESCRIPTION OF THE EMBODIMENTS

First Practical Example

An antenna module according to a first practical example is be described with reference to FIGS. 1 to 3.

Figure 1:
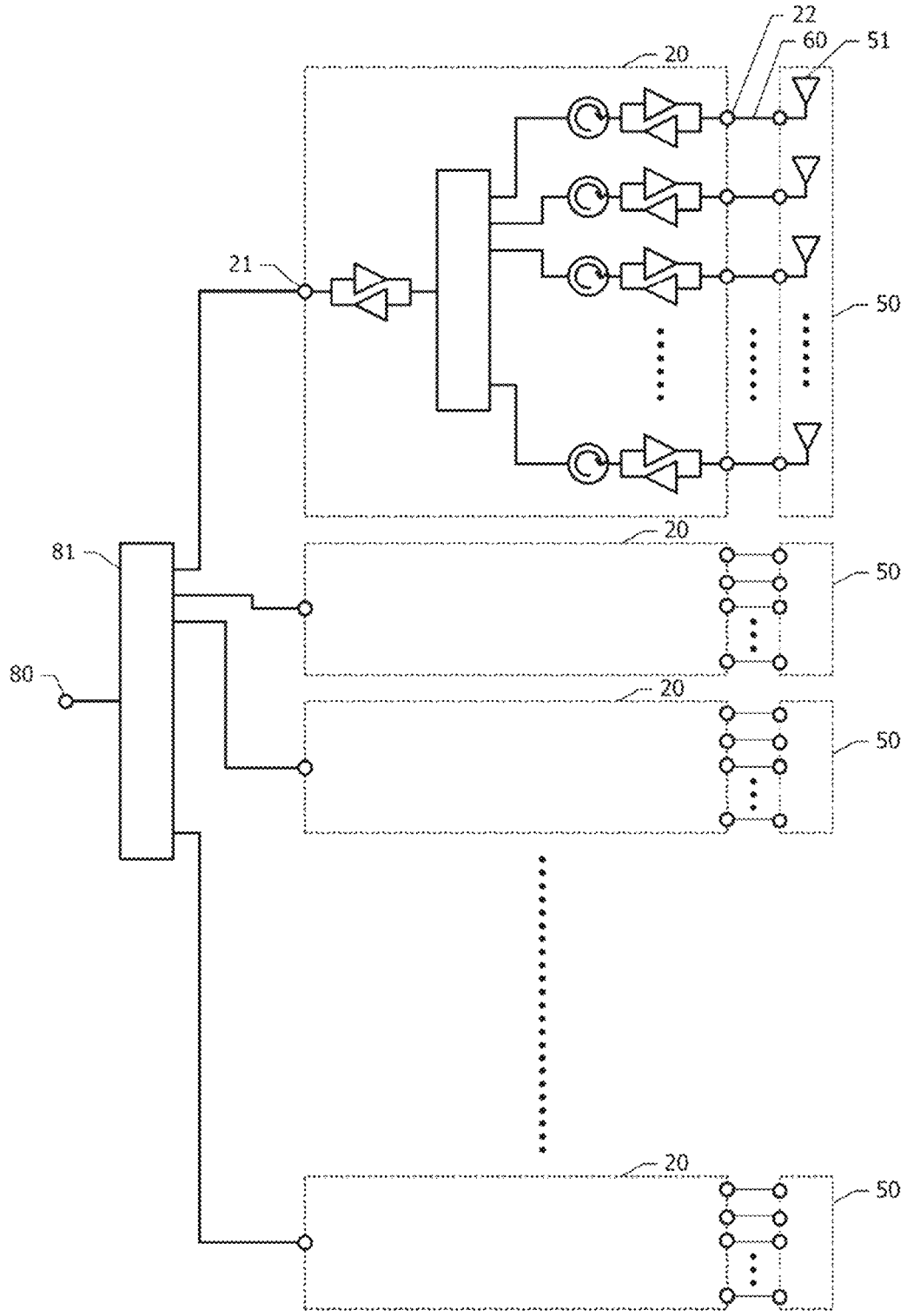
FIG. 1 is a block diagram of an antenna module according to a first practical example.

FIG. 1 is a block diagram of the antenna module according to the first practical example. The antenna module according to the first practical example includes a plurality of segments 20 that perform power amplification of a radio-frequency signal, subarray antennas 50 arranged so as to correspond to the respective plurality of segments 20, and a plurality of transmission lines 60. Each of the plurality of segments 20 includes one input-output port 21 and a plurality of antenna ports 22. As used herein the term "high-frequency" is not intended to refer to the HF band (3 MHz to 30 MHz), but rather radio-frequency such as the quasi-millimeter wave range and the mm wave range, including 24 GHz to 300 GHz. Also as used herein, the term "segment" should be construed as an electrical circuit with one or more active and/or passive components. Thus, multiple segments connected to one another are interconnected electrical circuits. A configuration of the segment 20 will be described later with reference to FIG. 2.

A plurality of subarray antennas 50 each include a plurality of circularly polarized antenna elements 51. The plurality of circularly polarized antenna elements 51 included in each of the plurality of subarray antennas 50 constitute a sequential array for each subarray antenna 50. The number of circularly polarized antenna elements 51 included in the subarray antenna 50 is equal to the number of antenna ports 22 of the corresponding segment 20. The antenna ports 22 of the segment 20 are connected to the respective corresponding circularly polarized antenna elements 51 of the subarray antenna 50 with transmission lines 60.

A radio-frequency signal input from one signal port 80 is distributed to input-output ports 21 of the respective plurality of segments 20 by a distribution-combination circuit 81. Each of the segments 20 subjects a radio-frequency signal input to the input-output port 21 to power amplification and phase adjustment and outputs radio-frequency signals from the plurality of antenna ports 22.

Reception signals received by the plurality of circularly polarized antenna elements 51 are input to the segment 20 from the respective plurality of antenna ports 22. The segment 20 subjects the reception signals input to the respective plurality of antenna ports 22 to amplification and phase adjustment, then combines the reception signals, and outputs a combined reception signal from the input-output port 21.

Reception signals output from the respective input-output ports 21 of the plurality of segments 20 are combined by the distribution-combination circuit 81, and a combined reception signal is output from the signal port 80.

Figure 2:
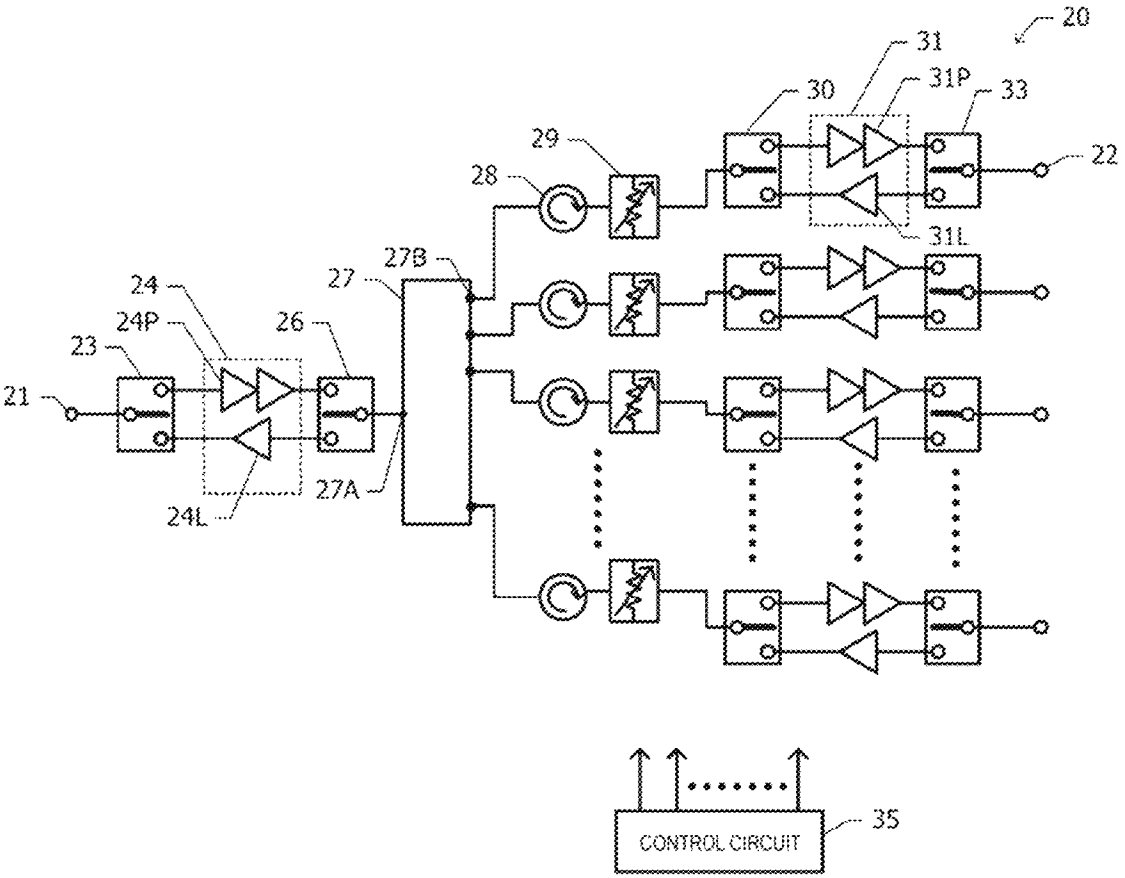
FIG. 2 is a block diagram of one segment of the antenna module according to the first practical example.

FIG. 2 is a block diagram of one segment 20 (FIG. 1). A distribution-combination circuit 27 includes one first port 27A and a plurality of second ports 27B. The distribution-combination circuit 27 distributes a signal input to the first port 27A to the plurality of second ports 27B and outputs signals. Furthermore, the distribution-combination circuit 27 combines signals input to the respective plurality of second ports 27B and outputs a combined signal from the first port 27A.

Between the input-output port 21 and the first port 27A of the distribution-combination circuit 27, a transmission-reception switch 23, a first amplifier 24, and a transmission-reception switch 26 are connected. The first amplifier 24 includes a first power amplifier 24P and a first low noise amplifier 24L. When the transmission-reception switches 23 and 26 are in a transmission state, a radio-frequency signal input from the input-output port 21 is amplified by the first power amplifier 24P and is input to the first port 27A of the distribution-combination circuit 27. When the transmission-reception switches 23 and 26 are in a reception state, a reception signal output from the first port 27A of the distribution-combination circuit 27 is amplified by the first low noise amplifier 24L and is output from the input-output port 21.

Between the plurality of second ports 27B of the distribution-combination circuit 27 and the respective plurality of antenna ports 22, a phase shifter 28, a variable attenuator 29, a transmission-reception switch 30, a second amplifier 31, and a transmission-reception switch 33 are connected. The second amplifier 31 includes a second power amplifier 31P and a second low noise amplifier 31L.

When the transmission-reception switches 30 and 33 are in a transmission state, a radio-frequency signal output from the corresponding second port 27B of the distribution-combination circuit 27 is output from the corresponding antenna port 22 through the phase shifter 28, the variable attenuator 29, and the second power amplifier 31P. When the transmission-reception switches 30 and 33 are in a reception state, a reception signal input from the corresponding antenna port 22 is input to the corresponding second port 27B of the distribution-combination circuit 27 through the second low noise amplifier 31L, the variable attenuator 29, and the phase shifter 28.

The phase shifter 28 adjusts a phase of a signal in accordance with control performed by a control circuit 35. The control circuit 35 may be discrete circuity (e.g., ASIC), or programmable circuitry such as a processor-based controller that is software programmable to perform control processing such as phased array processing to make phase adjustments to RF signals applied to (or received from) the antenna elements. The variable attenuator 29 adjusts an attenuation of a signal in accordance with control performed by the control circuit 35. The second power amplifier 31P amplifies power of a radio-frequency signal. The second low noise amplifier 31L amplifies a reception signal.

Figure 3:
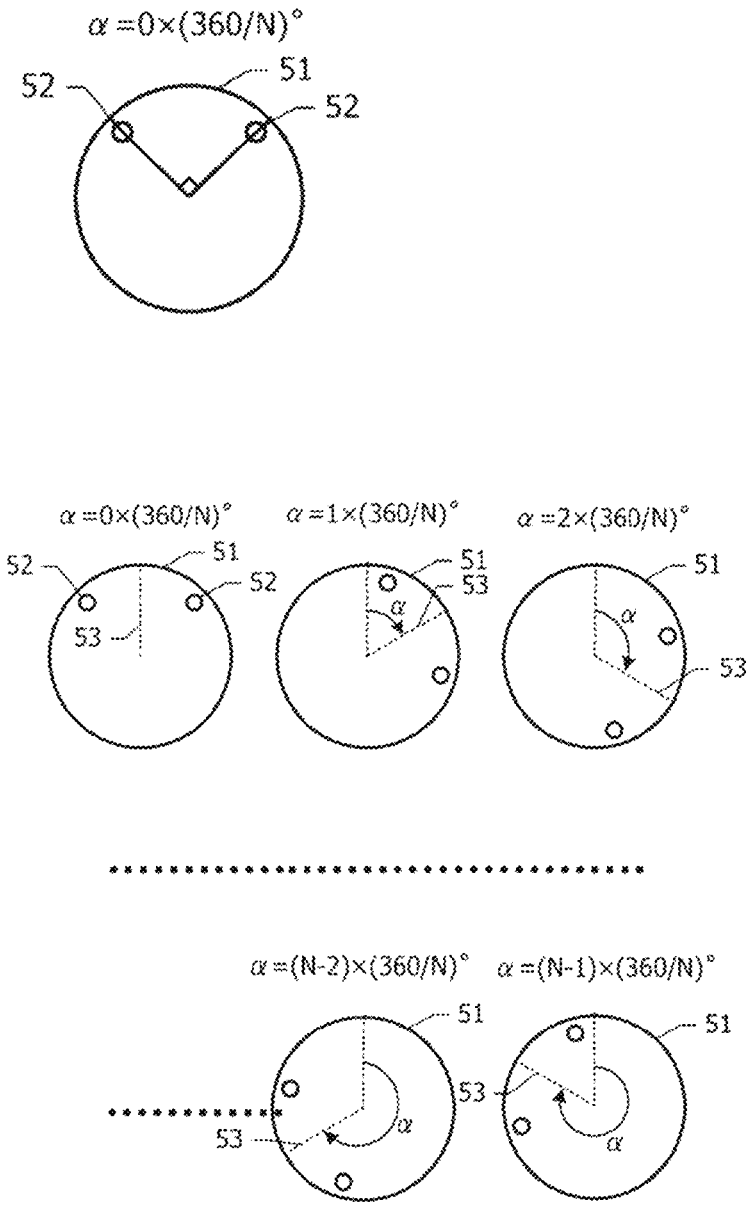
FIG. 3 is a plan view of a plurality of circularly polarized antenna elements included in one subarray antenna and constituting a sequential array.

FIG. 3 is a plan view of a plurality of circularly polarized antenna elements 51 included in one subarray antenna 50 (FIG. 1) and constituting a sequential array. The plurality of circularly polarized antenna elements 51 are substantially circular in shape when viewed in plan and each receive a supply of power from two feeding points 52. The two feeding points 52 are located on two respective radiuses within the circular shape of the antenna element 51 orthogonal to each other. When radio-frequency signals having a phase difference of about 90° are supplied to the two feeding points 52, a circularly polarized wave is radiated. A direction in which a circularly polarized wave to be radiated rotates (right-handed rotation or left-handed rotation) is determined by a phase lead or lag between two radio-frequency signals supplied to the two feeding points 52. Assume that a direction from a geometric center of each circularly polarized antenna element 51 toward a midpoint of a line segment having the two feeding points 52 as end points is a reference direction 53.

When successive numbers (sometimes referred to herein as "serial numbers") from 0 to N-1 are assigned sequentially to N circularly polarized antenna elements 51 constituting a sequential array, the reference direction 53 of an i-th circularly polarized antenna element 51 has an orientation rotated clockwise by a rotation angle $\alpha=(i\times360/N)°$ with respect to the reference direction 53 of a 0-th circularly polarized antenna element 51. For example, in the case where three circularly polarized antenna elements 51 constitute one sequential array, with respect to the reference direction 53 of the 0-th circularly polarized antenna element 51, the reference directions 53 of the other two respective circularly polarized antenna elements 51 are rotated by about 120° and about 240°. In the case where four circularly polarized antenna elements 51 constitute one sequential array, with respect to the reference direction 53 of the 0-th circularly polarized antenna element 51, the reference directions 53 of the other three respective circularly polarized antenna elements 51 are rotated by about 90°, about 180°, and about 270°.

As an exception, however, in the case where a sequential array is constituted by two circularly polarized antenna elements 51, it is desirable that the rotation angle $\alpha$ is about 90°.

Next, an excellent effect produced in the first practical example will be described.

In the antenna module according to the first practical example, in some communication distances or communication rates, all the circularly polarized antenna elements 51 do not necessarily have to be used (e.g., not excited during transmission and/or not included in the receive antenna array). For example, if a communication distance is short, or if a communication rate is slow, sufficient gain (i.e., directionality) may be provided even when only some circularly polarized antenna elements 51 are used.

With respect to a plurality of circularly polarized antenna elements 51 constituting a sequential array, when all the circularly polarized antenna elements 51 are used, an effect of best improving an axial ratio is achieved. When only some circularly polarized antenna elements 51 are used, there is a possibility that an effect sufficient to improve an axial ratio is not obtained. In the first practical example, among the plurality of segments 20, even when only one segment 20 is used, all circularly polarized antenna elements 51 constituting one sequential array are used. For this reason, an effect sufficient to improve an axial ratio can be obtained.

In the case where a plurality of circularly polarized antenna elements 51 constituting one sequential array are connected across a plurality of segments 20, to employ all of the plurality of circularly polarized antenna elements 51 constituting the one sequential array, the plurality of segments 20 have to be used. For example, the same number of second amplifiers 31 (FIG. 2) as the circularly polarized antenna elements 51 and a plurality of first amplifiers 24 have to be used. On the other hand, in the first practical example, to use all circularly polarized antenna elements 51 constituting one sequential array, the same number of second amplifiers 31 (FIG. 2) as the circularly polarized antenna elements 51 and one first amplifier 24 only have to be used. This enables low-power-consumption operation.

Next, a modification of the first practical example will be described.

Although the antenna module according to the first practical example includes both a transmission function and a reception function, an antenna module including only the transmission function or reception function may be constructed. In this case, transmission-reception switches 23, 26, 30, and 33 are unnecessary. Furthermore, the first amplifier 24 only has to include one of the first power amplifier 24P and the first low noise amplifier 24L. Similarly, the second amplifier 31 only has to include one of the second power amplifier 31P and the second low noise amplifier 31L.

In the first practical example, the plurality of subarray antennas 50 correspond one-to-one with the plurality of segments 20. As another configuration, the plurality of subarray antennas 50 may be provided for one segment 20. In other words, in any one subarray antenna 50 of the plurality of subarray antennas 50, a plurality of antenna ports 22 to which a respective plurality of circularly polarized antenna elements 51 included in one subarray antenna 50 are connected only have to be included in the one segment 20.

Second Practical Example

Next, an antenna module according to a second practical example will be described with reference to FIGS. 4 to 10. Hereinafter, a description of configurations that are the same as those of the antenna module (FIGS. 1 to 3) according to the first practical example is omitted.

Figure 4:
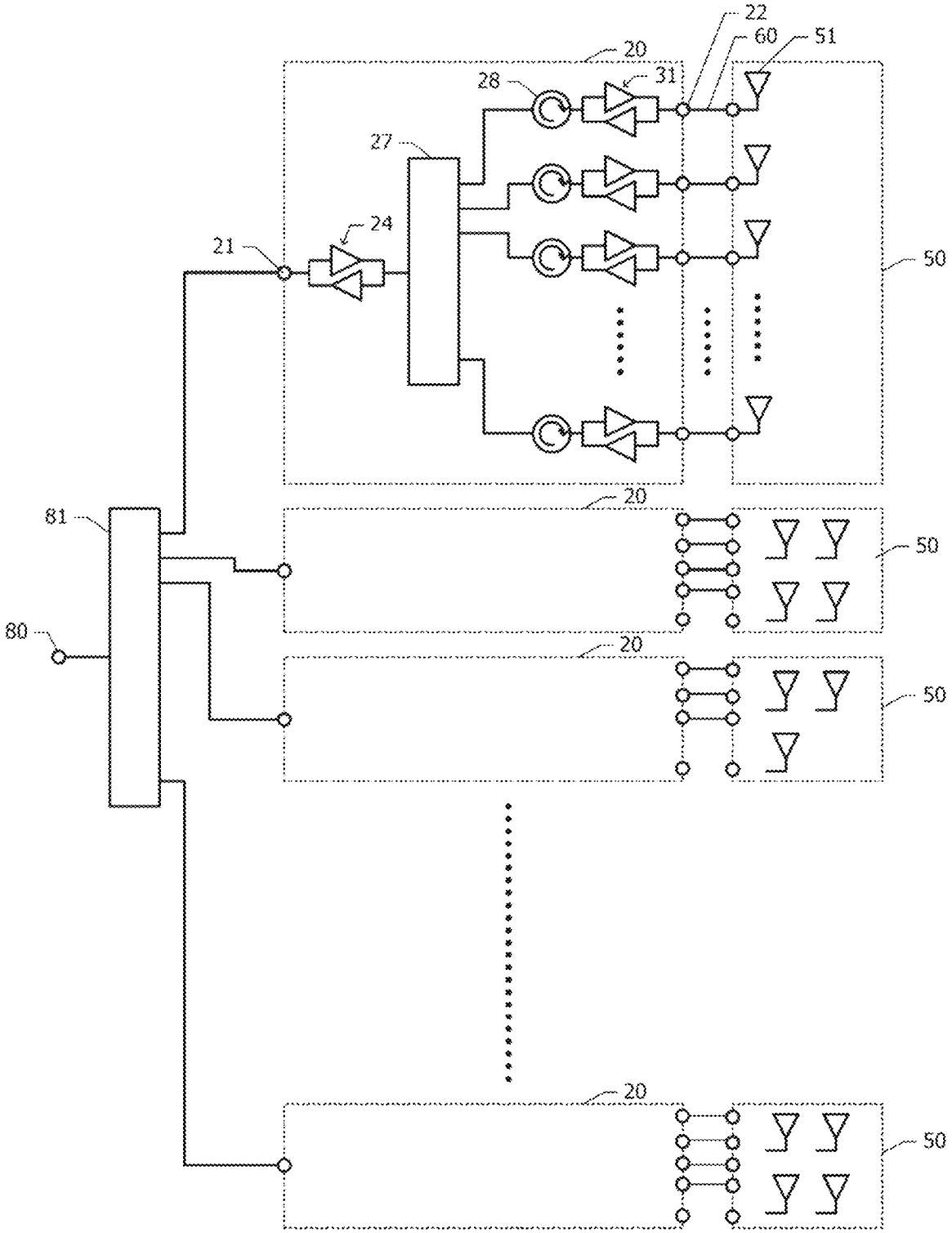
FIG. 4 is a block diagram of an antenna module according to a second practical example.

FIG. 4 is a block diagram of the antenna module according to the second practical example. In the first practical example, the number of antenna ports 22 of one segment 20 is equal to the number of circularly polarized antenna elements 51 constituting a subarray antenna 50 corresponding to the segment 20. On the other hand, in the second practical example, in some combinations of segments 20 and subarray antennas 50, the number of circularly polarized antenna elements 51 is smaller than the number of antenna ports 22. For example, there is a combination in which the number of antenna ports 22 is four and the number of circularly polarized antenna elements 51 of a subarray antenna 50 corresponding to the antenna ports 22 is three.

Figure 5A:
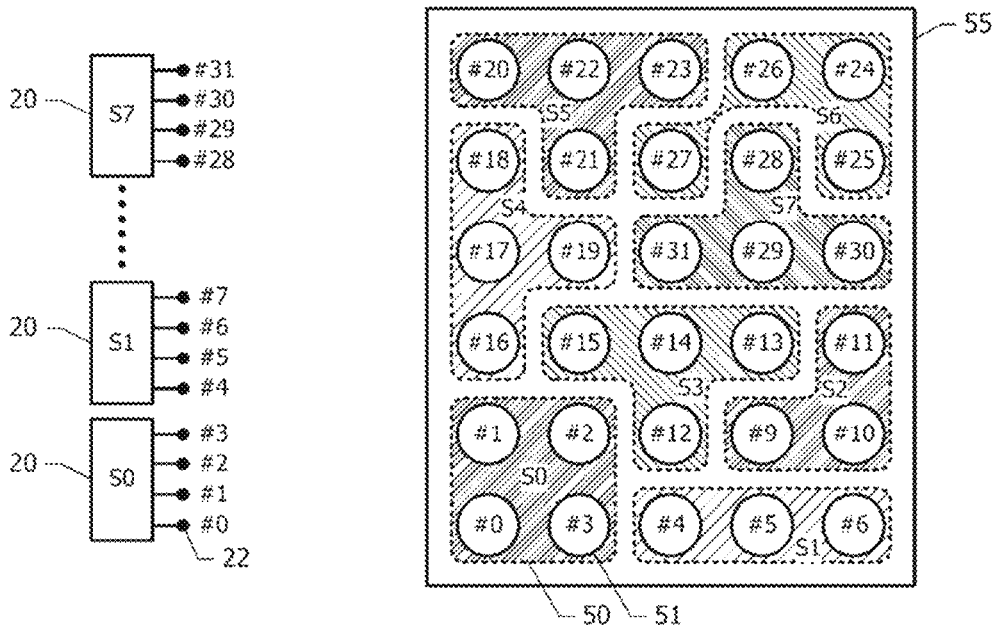
FIG. 5A is a schematic diagram illustrating an example of a planar arrangement of 30 circularly polarized antenna elements of the antenna module according to the second practical example.

FIG. 5A is a schematic diagram illustrating an example of a planar arrangement of 30 circularly polarized antenna elements 51. On a substrate 55, the 30 circularly polarized antenna elements 51 are arranged in a matrix with six rows and five columns. Power is supplied from eight segments 20 to the 30 circularly polarized antenna elements 51. Each of the eight segments 20 includes four antenna ports 22. In other words, a total of 32 antenna ports 22 are provided. Serial numbers are assigned to the eight segments 20, and serial numbers are also assigned to the 32 antenna ports 22. The serial numbers assigned to the segments 20 are represented by a number with a letter "S", and the serial numbers assigned to the antenna ports 22 are represented by a number with a sign "#". Serial numbers from S0 to S7 are assigned to the eight segments 20, and serial numbers from #0 to #31 are assigned to the 32 antenna ports 22. Assume that serial numbers assigned to four respective antenna ports 22 of a j-th segment 20 are 4j, 4j+1, 4j+2, and 4j+3.

Among a plurality of circularly polarized antenna elements 51, circularly polarized antenna elements 51 connected to the same segment 20 are surrounded by a dashed line, an area within the dashed line is hatched, and a serial number of the corresponding segment 20 is indicated by a number with a letter "S" in the area. Furthermore, serial numbers of antenna ports 22 connected to the circularly polarized antenna elements 51 are indicated by a number with a sign "#" in the respective circularly polarized antenna elements 51.

Three circularly polarized antenna elements 51 are connected to each of segments 20 whose serial numbers are S1 and S2. In other words, among four antenna ports 22 of each of the segments 20 whose serial numbers are S1 and S2, no circularly polarized antenna element 51 is connected to one antenna port 22. More specifically, no circularly polarized antenna elements 51 are connected to antenna ports 22 whose serial numbers are #7 and #8. With respect to each of the other segments 20, circularly polarized antenna elements 51 are connected to four respective antenna ports 22.

Figure 5B:
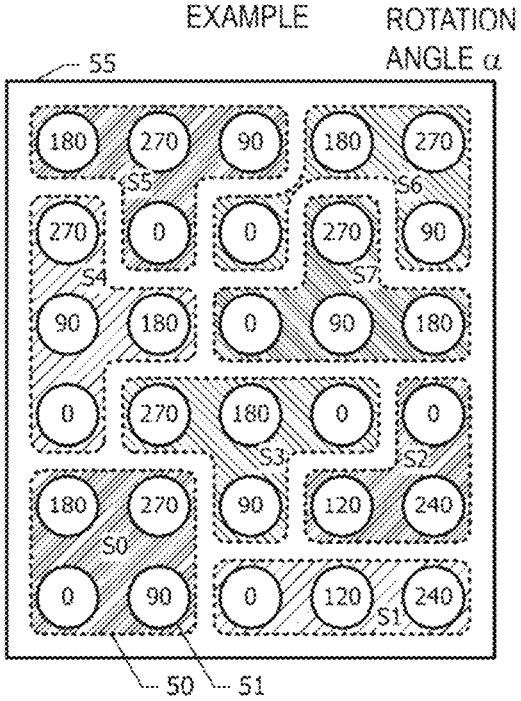
FIG. 5B illustrates a rotation angle $\alpha$ of each of the circularly polarized antenna elements in the antenna module according to the second practical example.

FIG. 5B illustrates a rotation angle α (FIG. 3) of each of the circularly polarized antenna elements 51 in the antenna module according to the second practical example. In the second practical example, a plurality of circularly polarized antenna elements 51 of a subarray antenna 50 connected to one segment 20 constitute a sequential array. For this reason, rotation angles α of four circularly polarized antenna elements 51 connected to each of the segments 20 whose serial numbers are S0, S3, S4, S5, S6, and S7 are about 0°, about 90°, about 180°, and about 270°. Rotation angles α of three circularly polarized antenna elements 51 connected to each of the segments 20 whose serial numbers are S1 and S2 are about 0°, about 120°, and about 240°.

Figure 5C:
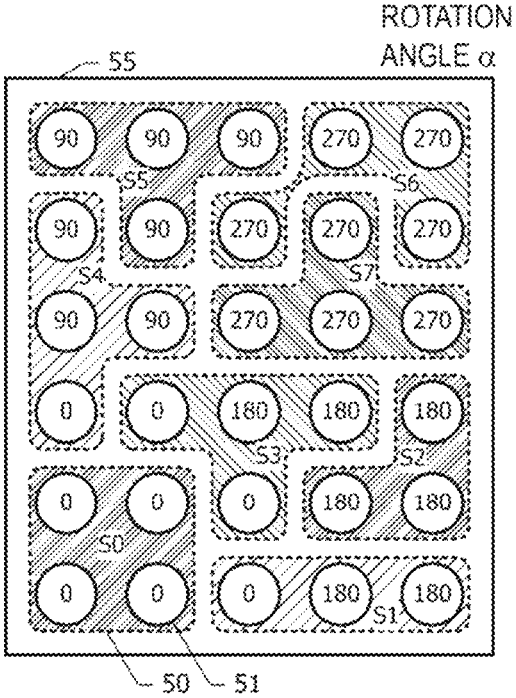
FIG. 5C illustrates a rotation angle $\alpha$ of each of circularly polarized antenna elements in an antenna module according to a comparative example.

FIG. 5C illustrates a rotation angle α (FIG. 3) of each of circularly polarized antenna elements 51 in an antenna module according to a comparative example. The rotation angle α of each of 30 circularly polarized antenna elements 51 is set so that the 30 circularly polarized antenna elements 51 constitute a sequential array as a whole. Specifically, a rotation angle α of each of eight circularly polarized antenna elements 51 arranged in a lower left region is set at about 0°. A rotation angle α of each of seven circularly polarized antenna elements 51 arranged in an upper left region is set at about 90°. A rotation angle α of each of seven circularly polarized antenna elements 51 arranged in a lower right region is set at about 180°. A rotation angle α of each of eight circularly polarized antenna elements 51 arranged in an upper right region is set at about 270°.

In the comparative example, although the 30 circularly polarized antenna elements 51 constitute a sequential array as a whole, three or four circularly polarized antenna elements 51 connected to each of the segments 20 are not intended to constitute a sequential array. For example, rotation angles α of four circularly polarized antenna elements 51 connected to a segment 20 whose serial number is S0 are all about 0°, and rotation angles α of three respective circularly polarized antenna elements 51 connected to a segment 20 whose serial number is S1 are about 0°, about 180°, and about 180°.

Next, an excellent effect produced in the second practical example will be described.

To verify an excellent effect produced in the second practical example, with respect to the antenna module (FIG. 5B) according to the second practical example and the antenna module (FIG. 5C) according to the comparative example, simulations for gain and axial ratio have been performed. Results of the simulations will be described with reference to FIGS. 6 to 10.

Figure 6:
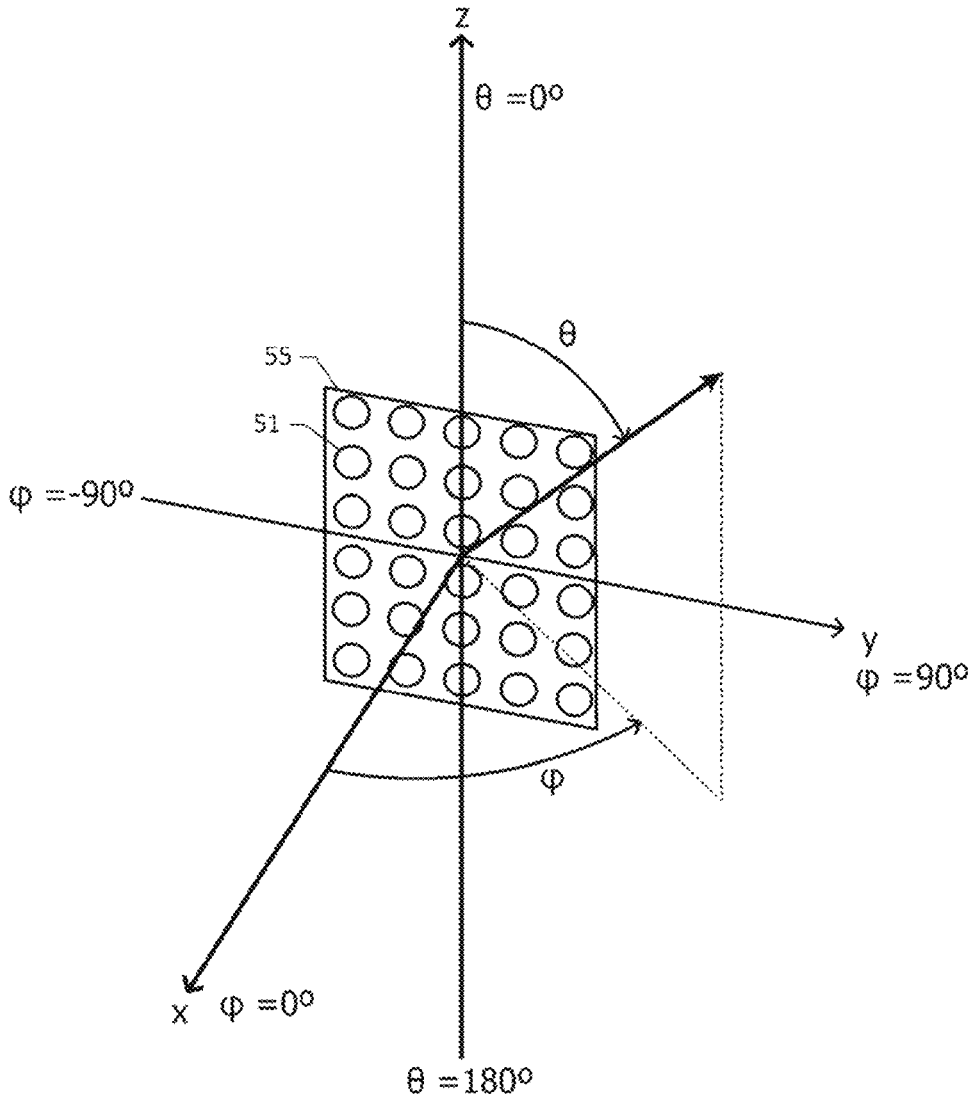
FIG. 6 is a perspective view illustrating a coordinate system for a substrate where a plurality of circularly polarized antenna elements are arranged.

FIG. 6 is a perspective view illustrating a coordinate system for the substrate 55 where 30 circularly polarized antenna elements 51 are arranged. A center of the 30 circularly polarized antenna elements 51 arranged in six rows and five columns serves as an origin, and a direction of a normal to the substrate 55 (a front direction of a plurality of circularly polarized antenna elements 51) serves as a positive direction of an x axis. In the 30 circularly polarized antenna elements 51 arranged in six rows and five columns, a row direction serves as a y axis direction, and a column direction serves as a z axis direction.

A polar angle with respect to a positive direction of the z axis is represented as θ, and an azimuth angle from the positive direction of the x axis is represented as ϕ. Radiation patterns in a z-x plane and an x-y plane have been obtained through simulation. Assume that excitation frequencies of a plurality of circularly polarized antenna elements 51 are a center frequency of each of channels 1 to 4 of the Institute of Electrical and Electronics Engineers (IEEE) 802.11ay, which is a wireless communication standard. Center frequencies of four channels of the channels 1 to 4 are respectively 58.32 GHz, 60.48 GHz, 62.64 GHz, and 64.8 GHz.

Although the 30 circularly polarized antenna elements 51 are designed to radiate a right-handed circularly polarized wave, a few left-handed circularly polarized wave components are typically included. In other words, an axial ratio of a circularly polarized wave radiated from each of the circularly polarized antenna elements 51 is larger than 0 dB. Furthermore, excitation phases of the plurality of circularly polarized antenna elements 51 are adjusted so that a right-handed circularly polarized wave forms a main beam in the positive direction of the x axis ($\theta=90°$, $\phi=0°$).

Simulations have been performed for the case where all the segments 20 (FIG. 5A) are used, the case where four segments 20 whose serial numbers are S0 to S3 are used, and the case where two segments 20 whose serial numbers are S0 and S1 are used. When all the segments 20 are used, all the 30 circularly polarized antenna elements 51 operate. When the four segments 20 whose serial numbers are S0 to S3 are used, 14 circularly polarized antenna elements 51 whose serial numbers are #0 to #6 and #9 to #15 operate. When the two segments 20 whose serial numbers are S0 and S1 are used, seven circularly polarized antenna elements 51 whose serial numbers are #0 to #6 operate.

Figure 7A:
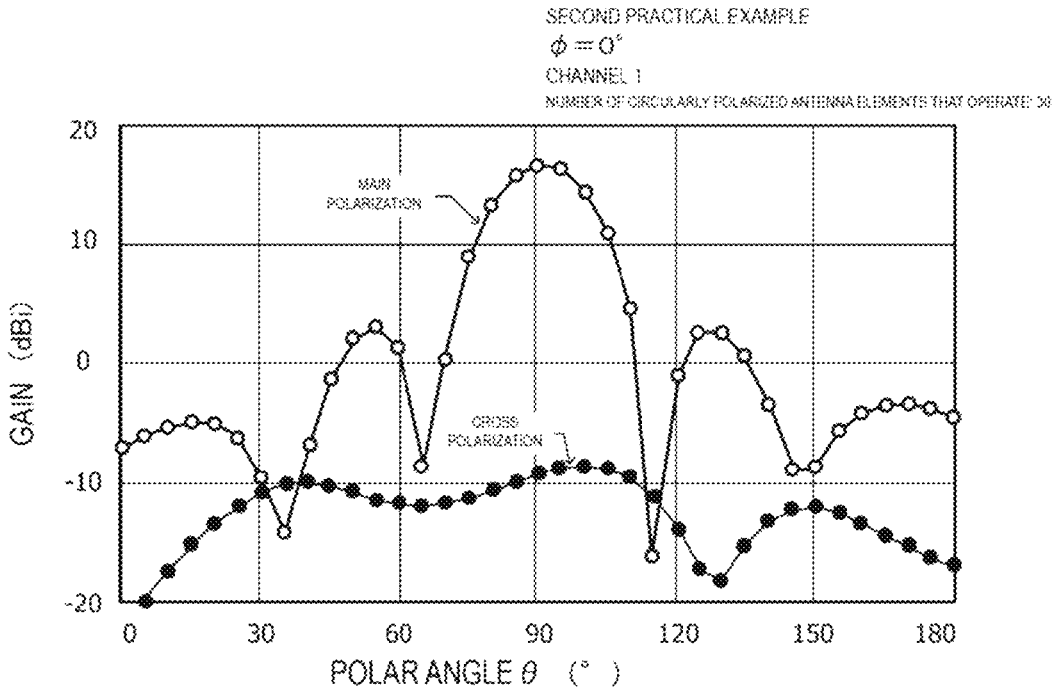
FIG. 7A is a graph illustrating a relationship between gain and polar angle $\theta$ in a z-x cross section ($\phi$=0°) exhibited when all circularly polarized antenna elements of the antenna module according to the second practical example are used at a center frequency (58.32 GHz) of a channel 1.

FIG. 7A is a graph illustrating a relationship between gain and polar angle $\theta$ in a z-x cross section ($\phi=0°$) exhibited when all the circularly polarized antenna elements 51 of the antenna module (FIG. 5B) according to the second practical example are caused to operate at a center frequency (58.32 GHz) of the channel 1. In the horizontal axis, the polar angle $\theta$ is expressed in the unit "°". In the vertical axis, the gain is expressed in the unit "dBi". In the graph, a hollow circle symbol represents the gain for main polarization (right-handed circularly polarized wave), and a filled circle symbol represents the gain for cross polarization (left-handed circularly polarized wave). In a direction (front direction) of the polar angle $\theta=90°$, a main beam of main polarization is formed.

Figure 7B:
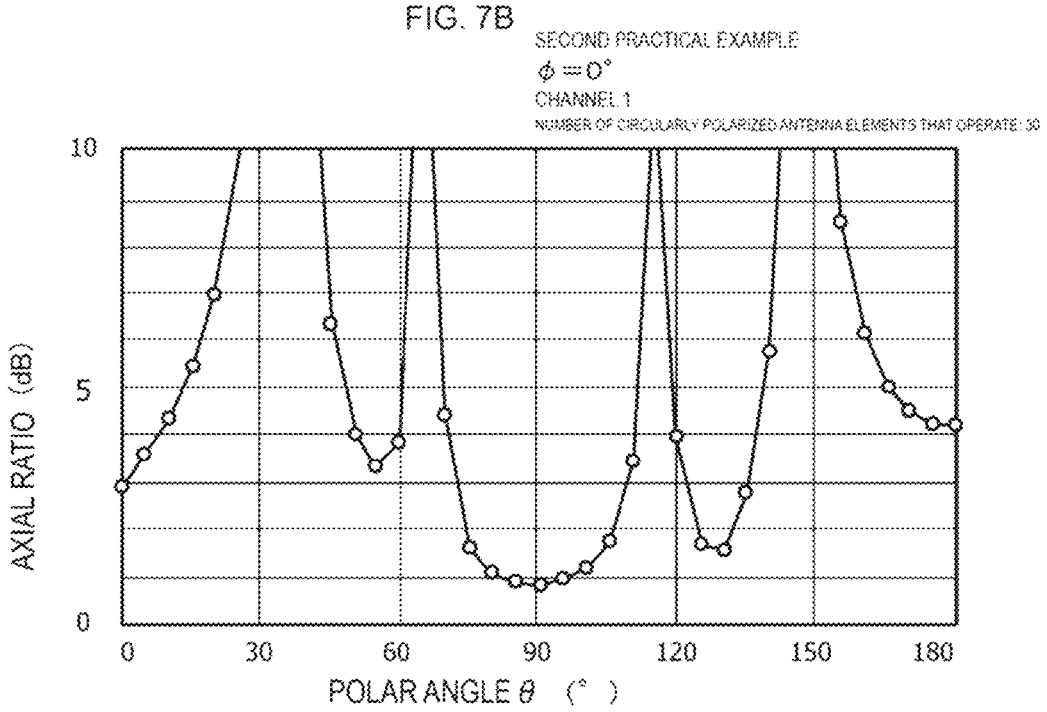
FIG. 7B is a graph illustrating an axial ratio obtained from simulation results illustrated in FIG. 7A.

FIG. 7B is a graph illustrating an axial ratio obtained from simulation results illustrated in FIG. 7A. It is seen that the axial ratio reaches a minimum in the front direction.

Figure 8A:
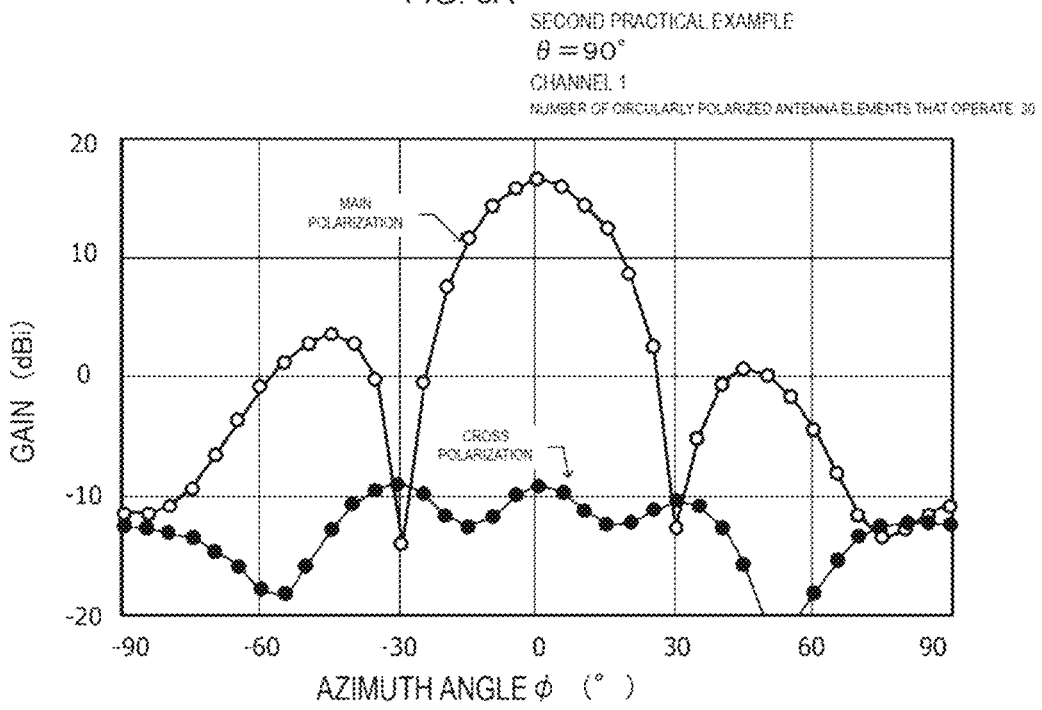
FIG. 8A is a graph illustrating a relationship between gain and azimuth angle $\phi$ in an x-y cross section ($\theta$=90°) exhibited when all the circularly polarized antenna elements of the antenna module according to the second practical example are used at the center frequency (58.32 GHz) of the channel 1.

FIG. 8A is a graph illustrating a relationship between gain and azimuth angle $\phi$ in an x-y cross section ($\theta=90°$) exhibited when all the circularly polarized antenna elements 51 of the antenna module (FIG. 5B) according to the second practical example are used at the center frequency (58.32 GHz) of the channel 1. In the horizontal axis, the azimuth angle $\phi$ is expressed in the unit "°". In the vertical axis, the gain is expressed in the unit "dBi". In the graph, a hollow circle symbol represents the gain for main polarization (right-handed circularly polarized wave), and a filled circle symbol represents the gain for cross polarization (left-handed circularly polarized wave). In a direction (front direction) of the azimuth angle $\phi=0°$, a main beam of main polarization is formed.

Figure 8B:
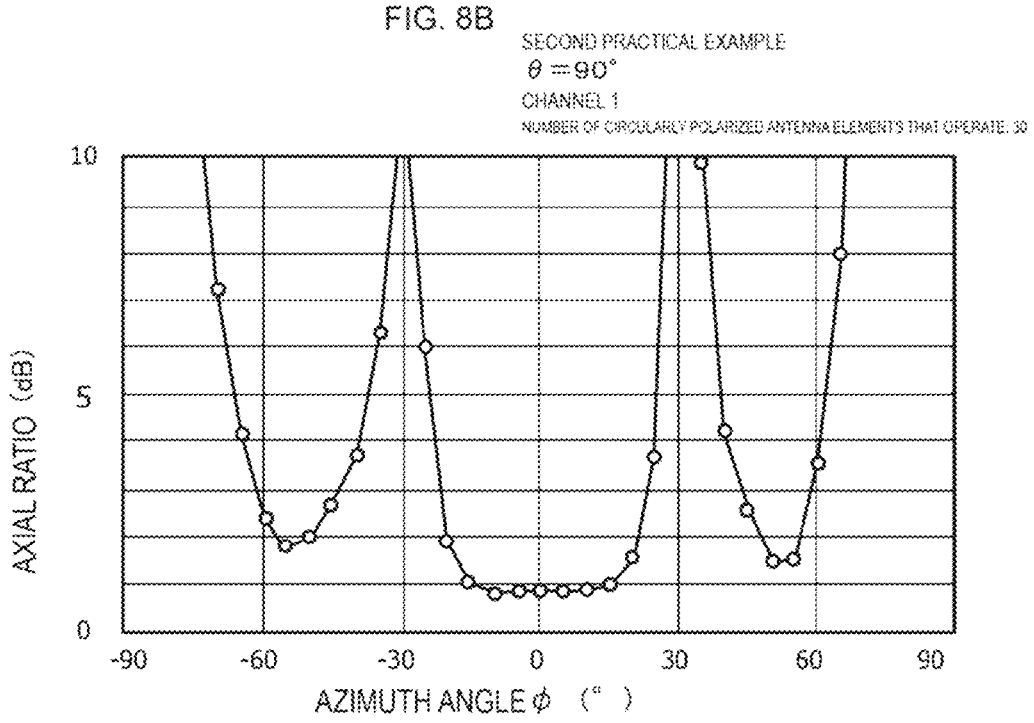
FIG. 8B is a graph illustrating an axial ratio obtained from simulation results illustrated in FIG. 8A.

FIG. 8B is a graph illustrating an axial ratio obtained from simulation results illustrated in FIG. 8A. It is seen that the axial ratio reaches a minimum in the front direction.

With respect to the antenna module (FIG. 5B) according to the second practical example and the antenna module (FIG. 5C) according to the comparative example, similar simulations have also been performed for a plurality of conditions that the numbers of segments 20 caused to operate and channels are different, and main polarization gains, cross polarization gains, and axial ratios have been obtained.

Figure 9A:
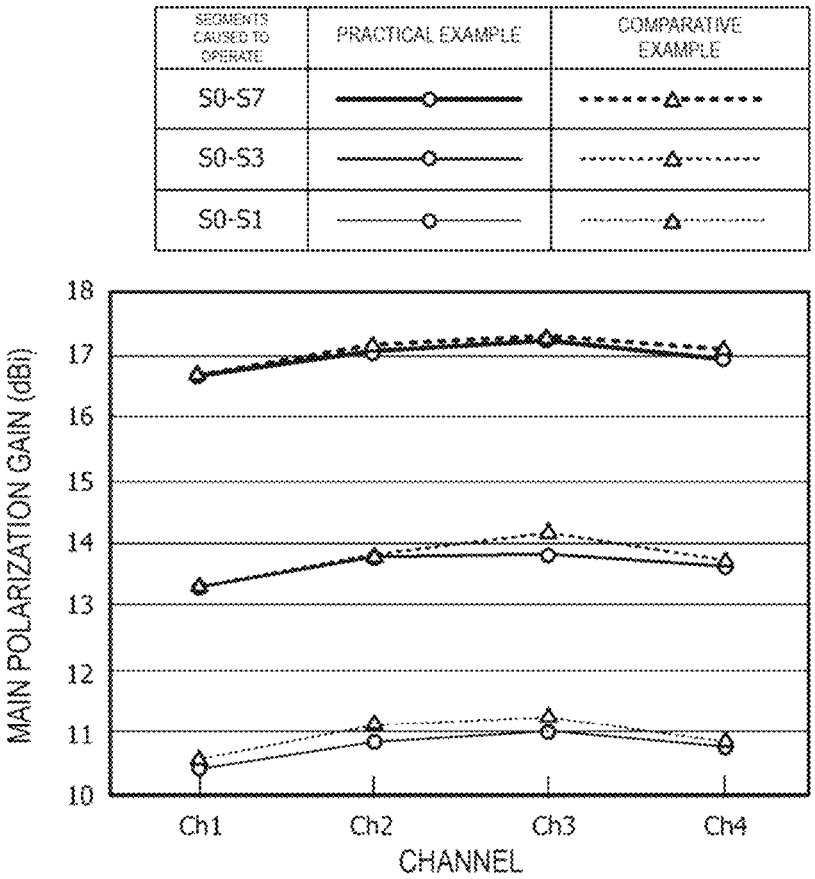
FIGS. 9A and 9B are graphs respectively illustrating main polarization gain and cross polarization gain for each channel.
Figure 9B:
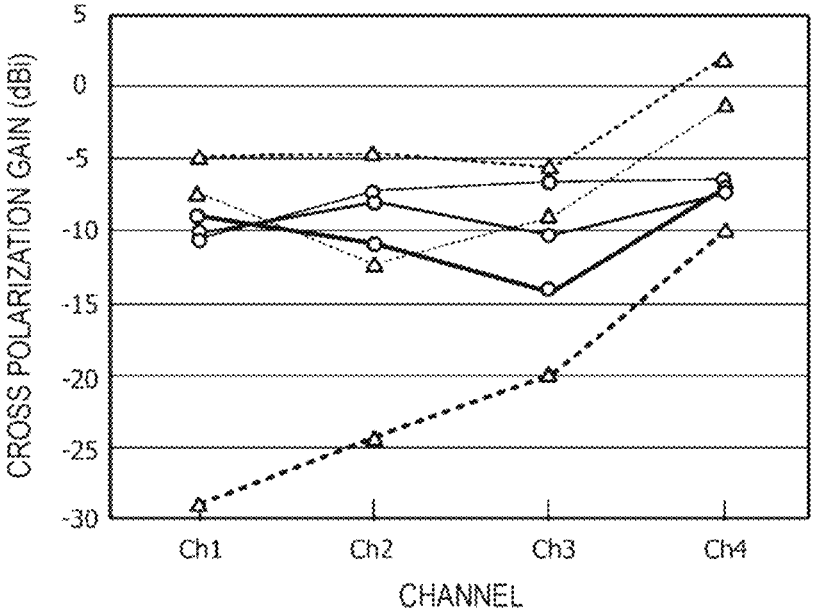

FIGS. 9A and 9B are graphs respectively illustrating main polarization gain and cross polarization gain for each channel. In FIGS. 9A and 9B, a solid line with circle symbols represents simulation results of the antenna module (FIG. 5B) according to the second practical example, and a dashed line with triangle symbols represents simulation results of the antenna module (FIG. 5C) according to the comparative example. Furthermore, the thicknesses of solid lines and dashed lines correspond to the numbers of segments 20 used. A thickest solid line and a thickest dashed line represent simulation results exhibited when all the segments 20 are used. A second thickest solid line and a second thickest dashed line represent simulation results exhibited when the four segments 20 whose serial numbers are S0 to S3 are used. A thinnest solid line and a thinnest dashed line represent simulation results exhibited when the two segments 20 whose serial numbers are S0 and S1 are used.

The main polarization gain decreases as the number of segments 20 caused to operate (in other words, the number of circularly polarized antenna elements 51 caused to operate) decreases. Note that, in terms of the main polarization gain (FIG. 9A), there is not a large difference between the antenna module (FIG. 5B) according to the second practical example and the antenna module (FIG. 5C) according to the comparative example, and a difference between channels is also small.

On the other hand, in terms of the cross polarization gain (FIG. 9B), there is a large difference between the antenna module (FIG. 5B) according to the second practical example and the antenna module (FIG. 5C) according to the comparative example. In particular, in the case of the comparative example, a cross polarization gain for the channel 4 is larger than those for the other channels.

Figure 10:
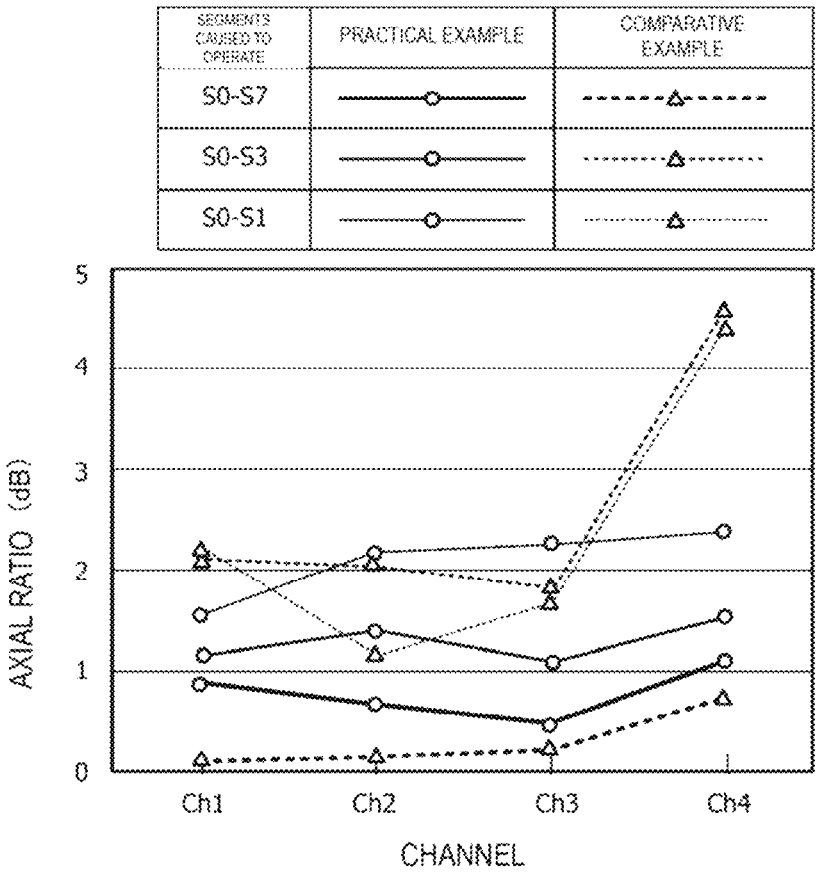
FIG. 10 is a graph illustrating axial ratios calculated from the graphs illustrated in FIGS. 9A and 9B for each channel.

FIG. 10 is a graph illustrating axial ratios calculated from the graphs illustrated in FIGS. 9A and 9B for each channel. In the graph, simulation conditions corresponding to solid lines, dashed lines, circle symbols, and triangle symbols are the same as those in the graphs illustrated in FIGS. 9A and 9B. In the antenna module (FIG. 5C) according to the comparative example, when the numbers of segments 20 used are four and two, axial ratios for the channel 4 are remarkably larger than axial ratios for the other channels, and the axial ratios are above 3 dB. On the other hand, in the antenna module (FIG. 5B) according to the second practical example, even when the number of segments 20 caused to operate is small, a favorable axial ratio, for example, of less than 3 dB is provided for all the channels.

Next, the reason why the simulation results illustrated in FIG. 10 have been obtained will be described.

When the segments 20 (FIG. 5A) whose serial numbers are S0 and S1 are used, the seven circularly polarized antenna elements 51 (FIG. 5A) whose serial numbers are #0 to #6 operate. At this time, in the comparative example (FIG. 5C), rotation angles $\alpha$ of five circularly polarized antenna elements 51 are about 0°, and rotation angles $\alpha$ of two circularly polarized antenna elements 51 are about 180°.

When the four segments 20 (FIG. 5A) whose serial numbers are S0 to S3 are used, the 14 circularly polarized antenna elements 51 (FIG. 5A) whose serial numbers are #0 to #6 and #9 to #15 operate. At this time, in the comparative example (FIG. 5C), rotation angles $\alpha$ of seven circularly polarized antenna elements 51 are about 0°, and rotation angles α of the other seven circularly polarized antenna elements 51 are about 180°.

Thus, in the comparative example, when only some segments 20 are used, a plurality of circularly polarized antenna elements 51 that operate do not constitute a sequential array. For this reason, an excellent effect that a sequential array has of improving an axial ratio is not obtained.

On the other hand, in the antenna module according to the second practical example, both in the case where the two segments 20 whose serial numbers are S0 and S1 are used and in the case where the four segments 20 whose serial numbers are S0 to S3 are used, a plurality of circularly polarized antenna elements 51 that operate constitute a sequential array composed of three or four circularly polarized antenna elements 51. For this reason, even when only some segments 20 are used, an effect that a sequential array has of improving an axial ratio is obtained.

Furthermore, as illustrated in FIG. 9A, the main polarization gain depends on the number of segments 20 used. The number of segments 20 used is reduced so that necessary gain is obtained, thereby enabling power-saving operation. In the second practical example, even when power-saving operation is performed, a sufficient axial ratio can be provided.

Next, a desirable arrangement of a plurality of circularly polarized antenna elements 51 will be described with reference to FIG. 11.

Figure 11:
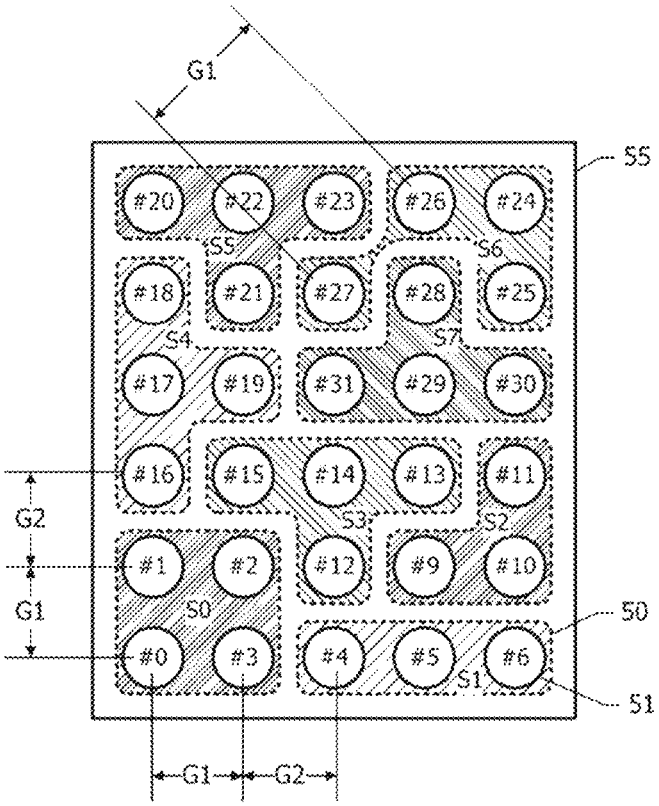
FIG. 11 illustrates a planar arrangement of the circularly polarized antenna elements of the antenna module according to the second practical example.

FIG. 11 illustrates a planar arrangement of the circularly polarized antenna elements 51 of the antenna module according to the second practical example. As in FIG. 5A, in FIG. 11, a plurality of circularly polarized antenna elements 51 included in one subarray antenna 50 are surrounded by a dashed line. Next, a desirable upper limit of a spacing between circularly polarized antenna elements 51 will be described.

Geometric centers of all circularly polarized antenna elements 51 included in one subarray antenna 50 are connected by line segments that are one fewer in number than the number of the circularly polarized antenna elements so that the total length of a plurality of line segments is shortest. At this time, a center-to-center distance (spacing) between two circularly polarized antenna elements 51 connected by a longest line segment is represented as G1.

For example, with respect to four circularly polarized antenna elements 51 connected to the segment 20 whose serial number is S0, the spacing G1 is provided between two circularly polarized antenna elements 51 adjacent to each other in a row direction or column direction. With respect to four circularly polarized antenna elements 51 connected to the segment 20 whose serial number is S6, the spacing G1 is provided between a circularly polarized antenna element 51 whose serial number is #26 and a circularly polarized antenna element 51 whose serial number is #27 in an oblique direction.

In the case where one subarray antenna 50 is used, to keep a grating lobe from appearing, it is desirable that the spacing G1 is not greater than a free-space wavelength corresponding to a resonant frequency of the circularly polarized antenna elements 51 in any one subarray antenna 50.

Furthermore, geometric centers of all circularly polarized antenna elements 51 are connected by line segments that are one fewer in number than the number of the circularly polarized antenna elements without being confined to one subarray antenna 50 so that the total length of a plurality of line segments is shortest. At this time, a center-to-center distance (spacing) between two circularly polarized antenna elements 51 connected by a longest line segment is represented as G2. In the second practical example, the spacing G2 is provided between two circularly polarized antenna elements 51 adjacent to each other in the row direction or column direction.

In the case where all subarray antennas 50 are used, to keep a grating lobe from appearing, it is desirable that the spacing G2 is not greater than a free-space wavelength corresponding to a resonant frequency of the circularly polarized antenna elements 51.

In the simulations described with reference to FIGS. 5A to 10, although the number of segments 20 is eight and the number of circularly polarized antenna elements 51 is 30, the respective numbers may be numbers other than eight and 30. Furthermore, although the number of circularly polarized antenna elements 51 included in one subarray antenna 50 is three or four, the number may be a number other than three or four.

Third Practical Example

Next, an antenna module according to a third practical example will be described with reference to FIG. 12A. Hereinafter, a description of configurations that are the same as those of the antenna module (FIGS. 1 to 3) according to the first practical example is omitted. Although a specific configuration of a connection between a circularly polarized antenna element 51 and a transmission line 60 (FIG. 1) is not described in the first practical example, a specific configuration of a connection between a circularly polarized antenna element 51 and a transmission line 60 will be clarified in the third practical example.

Figure 12A:
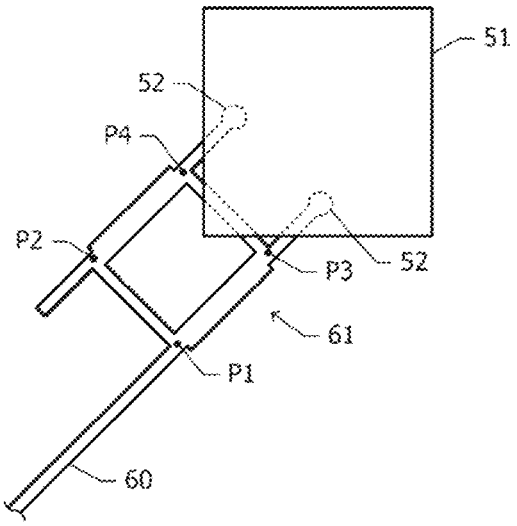
FIG. 12A is a plan view of a circularly polarized antenna element and a transmission line used in an antenna module according to a third practical example.

FIG. 12A is a plan view of a circularly polarized antenna element 51 and a transmission line 60 used in the antenna module according to the third practical example. The circularly polarized antenna element 51 is substantially square, for example, substantially regular square in shape when viewed in plan. Feeding points 52 are provided on line segments having, as end points, respective midpoints of two adjacent sides of the substantially square shape and a center of the substantially square shape.

The transmission line 60 is connected to two feeding points 52 through a hybrid circuit 61. The hybrid circuit 61 is constituted by four transmission lines located along four sides of a substantially rectangular shape. Portions corresponding to four vertices of the substantially rectangular shape function as four respective ports P1, P2, P3, and P4 of the hybrid circuit 61. The transmission line 60 is connected to the port P1 of the hybrid circuit 61, and the two feeding points 52 are connected to the respective ports P3 and P4 of the hybrid circuit 61. An open stub is connected to the port P2. Incidentally, in place of the open stub, a short stub, a reflection-free termination, or a transmission line of a certain length may be connected to the port P2.

A radio-frequency signal transmitted through the transmission line 60 and input to the port P1 is output as radio-frequency signals having a phase difference of about 90° between each other from two ports P3 and P4. Thus, the circularly polarized antenna element 51 is excited so as to radiate a circularly polarized wave, for example, a right-handed circularly polarized wave. When the circularly polarized antenna element 51 receives a right-handed circularly polarized wave, reception signals are combined and output from the port P1 to the transmission line 60. In the case of a configuration in which the transmission line 60 is connected to the port P2 of the hybrid circuit 61, the circularly polarized antenna element 51 can radiate a left-handed circularly polarized wave and receive a left-handed circularly polarized wave.

Figure 12B:
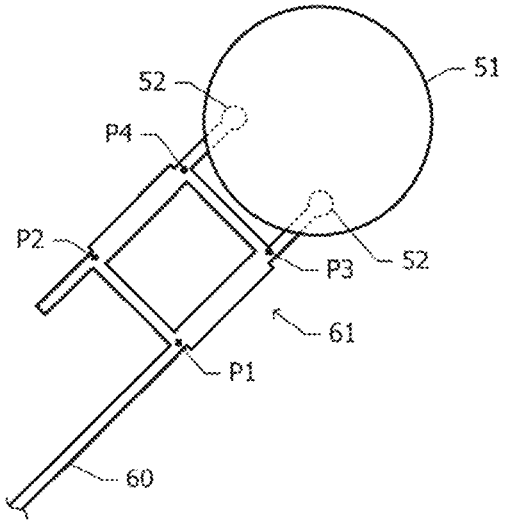
FIG. 12B is a plan view of a circularly polarized antenna element and a transmission line used in an antenna module according to a modification of the third practical example.

FIG. 12B is a plan view of a circularly polarized antenna element 51 and a transmission line 60 used in an antenna module according to a modification of the third practical example. The circularly polarized antenna element 51 used in the antenna module according to this modification is substantially circular in shape when viewed in plan. Feeding points 52 are provided on two respective radiuses orthogonal to each other of the substantially circular shape. As in this modification, a circularly polarized antenna element 51 may be substantially circular in shape.

Next, an antenna module according to another modification of the third practical example will be described with reference to FIGS. 13A and 13B.

Figure 13A:
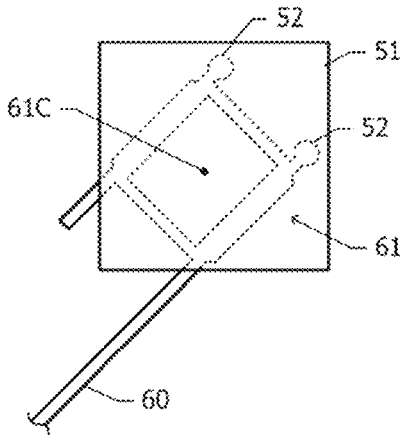
FIGS. 13A and 13B are each a plan view of a circularly polarized antenna element and a transmission line used in an antenna module according to another modification of the third practical example.
Figure 13B:
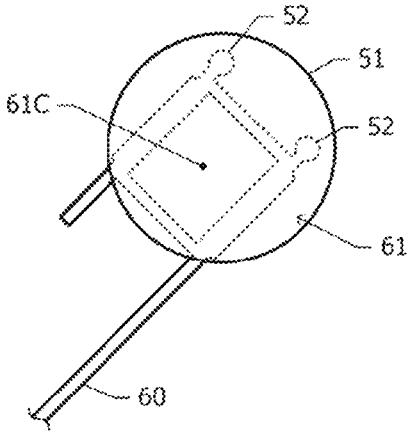

FIGS. 13A and 13B are each a plan view of a circularly polarized antenna element 51 and a transmission line 60 used in the antenna module according to this modification. In a modification illustrated in FIG. 13A, the circularly polarized antenna element 51 is substantially square in shape. In a modification illustrated in FIG. 13B, the circularly polarized antenna element 51 is substantially circular in shape. In the third practical example illustrated in FIG. 12A and the modification of the third practical example illustrated in FIG. 12B, a geometric center of the hybrid circuit 61 is located outside the circularly polarized antenna element 51 when viewed in plan. On the other hand, in the modification illustrated in FIG. 13A, a geometric center 61C of the hybrid circuit 61 is located within the circularly polarized antenna element 51 when viewed in plan. Such a layout enables space savings.

An electrical length of one side of the substantially square circularly polarized antenna element 51 and an electrical length of a diameter of the substantially circular circularly polarized antenna element 51 are nearly equal to about one half of wavelengths corresponding to resonant frequencies of the respective circularly polarized antenna elements 51. On the other hand, an electrical length of each of the four transmission lines constituting the hybrid circuit 61 is nearly equal to about a quarter of a wavelength corresponding to a resonant frequency of each of the circularly polarized antenna elements 51. For this reason, the hybrid circuit 61 can be disposed so as to be encompassed by the circularly polarized antenna element 51 when viewed in plan. The hybrid circuit 61 is disposed so as to be encompassed by the circularly polarized antenna element 51, thereby enabling further space savings.

Furthermore, in the case where a sequential array is constituted by a plurality of circularly polarized antenna elements 51, the circularly polarized antenna elements 51 are arranged with each rotated by a given angle as illustrated in FIG. 3. As illustrated in FIG. 12A, in the configuration in which the hybrid circuit 61 is disposed outside the circularly polarized antenna element 51 when viewed in plan, hybrid circuits 61 connected to two respective adjacent circularly polarized antenna elements 51 can spatially interfere with each other. On the other hand, in the modifications illustrated in FIGS. 13A and 13B, at least part of the hybrid circuit 61 overlaps the circularly polarized antenna element 51 when viewed in plan, and thus an excellent effect of keeping spatial interference between hybrid circuits 61 from occurring is obtained.

Next, a desirable shape of a circularly polarized antenna element 51 will be described with reference to FIGS. 14A and 14B.

Figure 14A:
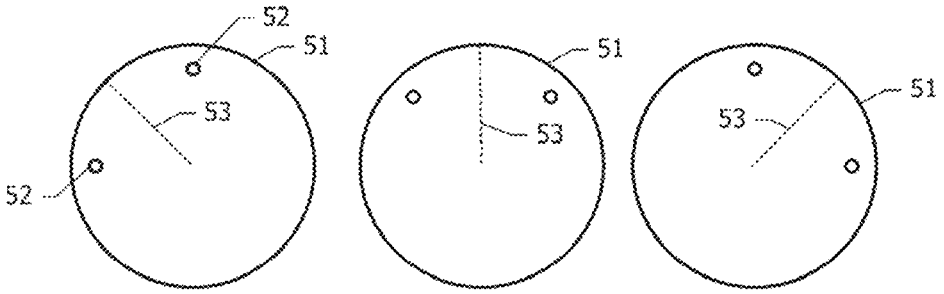
FIG. 14A illustrates a positional relationship of three circularly polarized antenna elements that are circular in shape in the case where the circularly polarized antenna elements are arranged in a line.

FIG. 14A illustrates a positional relationship of three circularly polarized antenna elements 51 that are substantially circular in shape in the case where the circularly polarized antenna elements 51 are arranged in a line. FIG. 14B illustrates a positional relationship of three circularly polarized antenna elements 51 that are substantially regular square in shape in the case where the circularly polarized antenna elements 51 are arranged in a line.

Figure 14B:
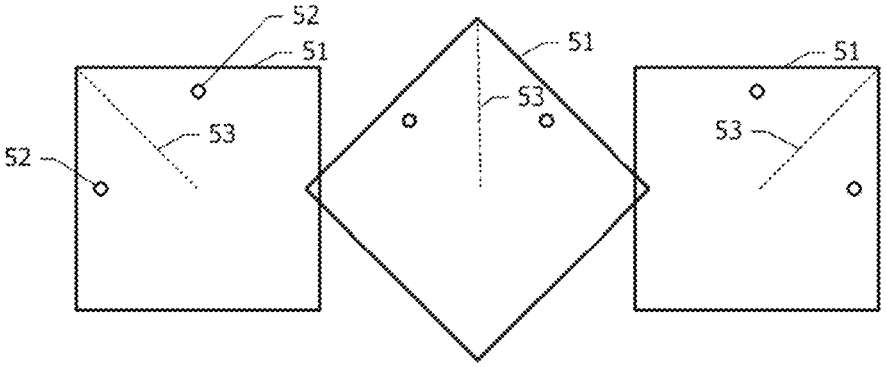
FIG. 14B illustrates a positional relationship of three circularly polarized antenna elements that are regular square in shape in the case where the circularly polarized antenna elements are arranged in a line.

In each of FIGS. 14A and 14B, with respect to a reference direction 53 of a leftmost circularly polarized antenna element 51, reference directions 53 of respective second and third circularly polarized antenna elements 51 from the left are rotated clockwise by about 45° and about 90°.

In the case where circularly polarized antenna elements 51 are substantially circular in shape (FIG. 14A), even when orientations of reference directions 53 are changed, positions of the external shapes of the respective circularly polarized antenna elements 51 remain unchanged. On the other hand, in the case where circularly polarized antenna elements 51 are substantially regular square in shape (FIG. 14B), when reference directions 53 are rotated by about 45°, positions of the external shapes of the respective circularly polarized antenna elements 51 are changed. For example, in an example illustrated in FIG. 14B, one diagonal line of the circularly polarized antenna element 51 in the center is parallel to a direction in which the three circularly polarized antenna elements 51 are arranged.

When a substantially circular circularly polarized antenna element 51 and a substantially regular square circularly polarized antenna element 51 are equal in resonant frequency, a length of one side of the substantially regular square circularly polarized antenna element 51 is nearly equal to a diameter of the substantially circular circularly polarized antenna element 51. A diagonal line of a regular square is longer than one side, and thus, when spacings between a plurality of circularly polarized antenna elements 51 are reduced, part of one circularly polarized antenna element 51 can come in contact with an adjacent circularly polarized antenna element 51.

On the other hand, in the case where circularly polarized antenna elements 51 are substantially circular in shape, even when each of reference directions 53 of two circularly polarized antenna elements 51 adjacent to each other is changed by about 45°, the two circularly polarized antenna elements 51 do not come in contact with each other. In the case where a plurality of circularly polarized antenna elements 51 are arranged at narrow spacings, it is desirable that the circularly polarized antenna elements 51 are substantially circular in shape.

Fourth Practical Example

Next, an antenna module according to a fourth practical example will be described with reference to FIGS. 15A and 15B. Hereinafter, a description of configurations that are the same as those of the antenna module (FIGS. 1 to 3) according to the first practical example is omitted.

Figure 15A:
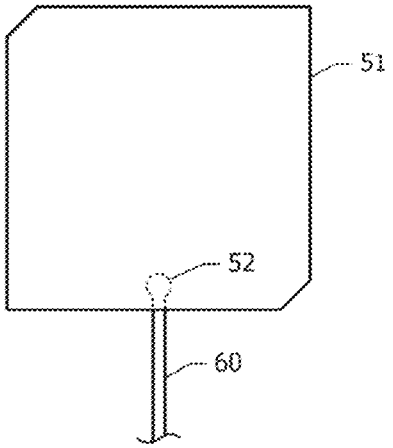
FIGS. 15A and 15B are each a plan view of a circularly polarized antenna element used in an antenna module according to a fourth practical example.
Figure 15B:
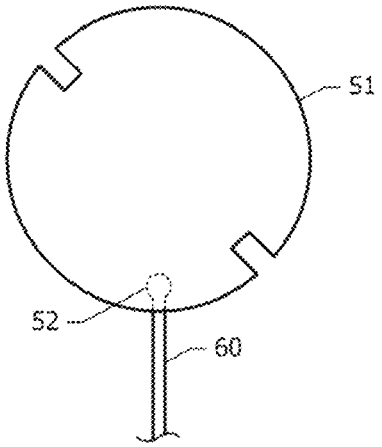

FIGS. 15A and 15B are each a plan view of a circularly polarized antenna element 51 used in an antenna module according to the fourth practical example. In the first practical example, radio-frequency signals having a phase difference are supplied to each of the circularly polarized antenna elements 51 from two feeding points 52 (FIG. 3), thereby generating a circularly polarized wave. On the other hand, in the fourth practical example, a perturbation element is used as a circularly polarized antenna element 51.

The circularly polarized antenna element 51 illustrated in FIG. 15A has a shape in which triangular portions including two respective vertices located on one diagonal line of the substantially square element are cut away. A feeding point 52 is provided on a line segment connecting a midpoint of one side and a center of the circularly polarized antenna element 51.

The circularly polarized antenna element 51 illustrated in FIG. 15B has a shape in which indentations are formed in portions corresponding to end points of one diameter of the substantially circular element. A feeding point 52 is located on a radius forming an angle of about 45° with respect to the diameter having indentation portions as the end points.

Next, an excellent effect produced in the fourth practical example will be described.

In the fourth practical example, the number of feeding points 52 provided in each of circularly polarized antenna elements 51 is one, and thus power can be supplied without passing through the hybrid circuit 61 illustrated in FIG. 12A or the like. This can increase flexibility in routing the transmission line 60.

Fifth Practical Example

Next, an antenna module according to a fifth practical example will be described with reference to FIG. 16. Hereinafter, a description of configurations that are the same as those of the antenna module (FIGS. 4, 5A, and 5B) according to the second practical example is omitted.

Figure 16:
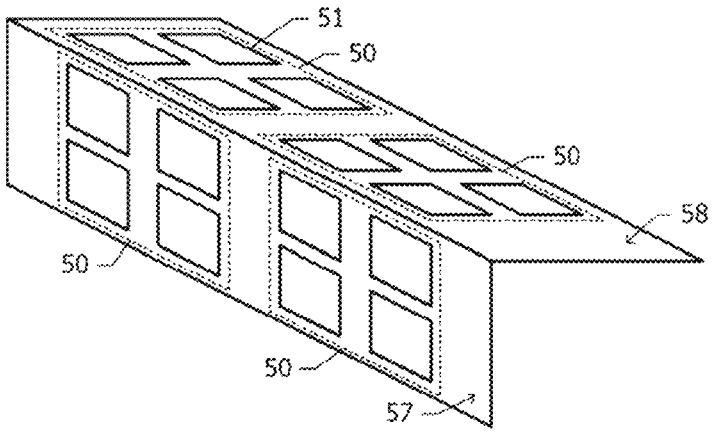
FIG. 16 is a perspective view illustrating an arrangement of a plurality of circularly polarized antenna elements of an antenna module according to a fifth practical example.

FIG. 16 is a perspective view illustrating an arrangement of a plurality of circularly polarized antenna elements 51 of the antenna module according to the fifth practical example. A first surface 57 and a second surface 58 cross each other at right angles. Some subarray antennas 50 of a plurality of subarray antennas 50 are arranged along the first surface 57, and the other subarray antennas 50 are arranged along the second surface 58. In other words, a front direction of some subarray antennas 50 differs from a front direction of the other subarray antennas 50.

Next, an excellent effect produced in the fifth practical example will be described.

The antenna module according to the fifth practical example can achieve wide coverage. Furthermore, when it is desired to aim a main beam in a front direction of the first surface 57, the subarray antennas 50 arranged along the first surface 57 are used, and the subarray antennas 50 arranged along the second surface 58 are not used, thereby making it possible to achieve power savings. Similarly, when it is desired to aim a main beam in a front direction of the second surface 58, power savings can be achieved. Furthermore, even when a main beam is aimed both in the front direction of the first surface 57 and in the front direction of the second surface 58, a favorable axial ratio can be obtained.

Next, a modification of the fifth practical example will be described.

In the fifth practical example, a plurality of subarray antennas 50 are arranged along each of two planes of the first surface 57 and the second surface 58. A plurality of subarray antennas 50 may be arranged along each of three or more planes whose front directions are different. This configuration can further widen coverage. Furthermore, a direction in which a main beam faces can be more finely controlled.

Sixth Practical Example

Next, an antenna module according to a sixth practical example will be described with reference to FIG. 17. Hereinafter, a description of configurations that are the same as those of the antenna module (FIGS. 4, 5A, and 5B) according to the second practical example is omitted.

Figure 17:
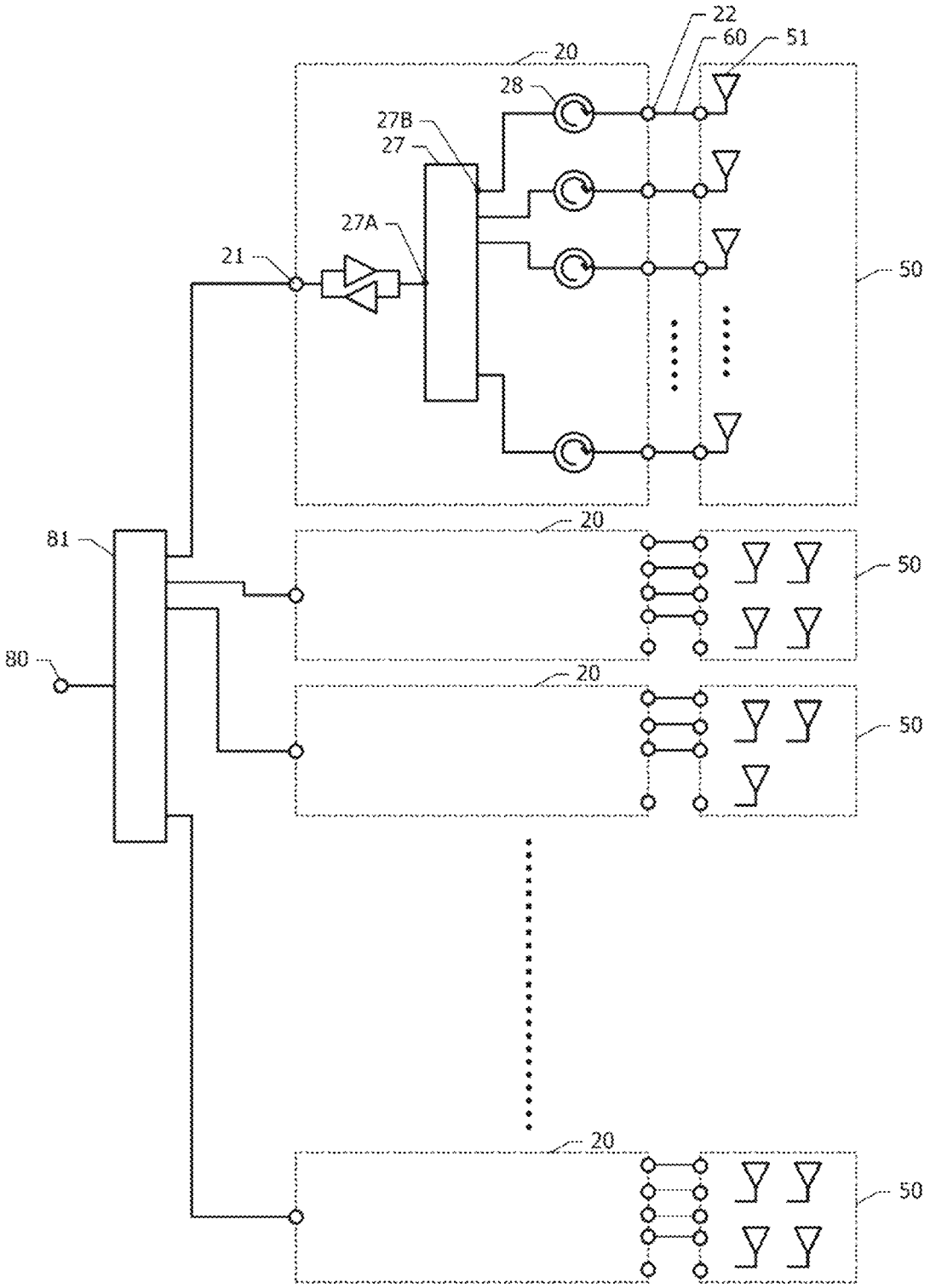
FIG. 17 is a block diagram of an antenna module according to a sixth practical example.

FIG. 17 is a block diagram of the antenna module according to the sixth practical example. In the sixth practical example, the second amplifiers 31 (FIGS. 4 and 2) included in the antenna module according to the second practical example are omitted. The distribution-combination circuit 27 distributes a signal input to the first port 27A to the plurality of antenna ports 22 through the second ports 27B and the phase shifters 28. Furthermore, the distribution-combination circuit 27 combines signals input to the respective plurality of antenna ports 22 and transmitted to the second ports 27B through the phase shifters 28 and outputs a combined signal from the first port 27A.

Next, an excellent effect produced in the sixth practical example will be described.

As in the second practical example, in the sixth practical example, even when only some segments 20 are used, a sufficient axial ratio can be provided. For this reason, power-saving operation is compatible with an improvement in axial ratio.

Seventh Practical Example

Next, an antenna driving method according to a seventh practical example will be described.

In the second practical example illustrated in FIGS. 5A and 5B, eight first amplifiers 24 are configured to cause 30 circularly polarized antenna elements 51 to operate. Furthermore, any one of the eight first amplifiers 24 is configured to cause, among the 30 circularly polarized antenna elements 51, three or four circularly polarized antenna elements 51 to operate.

In the seventh practical example, the number of first amplifiers 24 is not limited to eight, and the number of circularly polarized antenna elements 51 is also not limited to 30. Furthermore, the number of circularly polarized antenna elements 51 constituting one sequential array is also not limited to three or four. For example, a configuration is adopted in which M number of circularly polarized antenna elements 51 are used with a plurality of first amplifiers 24, and any one of the plurality of first amplifiers 24 is configured to cause, among the M number of circularly polarized antenna elements 51, a plurality of circularly polarized antenna elements 51 to operate. Here, M is an integer not less than four. The M number of circularly polarized antenna elements 51 constitute a plurality of sequential arrays.

In selecting m number of circularly polarized antenna elements 51 smaller in number than M and causing the selected circularly polarized antenna elements 51 to operate, m number of circularly polarized antenna elements 51 are selected from among the M number of circularly polarized antenna elements 51 in order that the following two conditions be satisfied. A first condition is that selected m number of circularly polarized antenna elements 51 constitute one or a plurality of sequential arrays. A second condition is that the number of first amplifiers 24 necessary to cause m number of circularly polarized antenna elements 51 to operate is a minimum.

Next, an excellent effect produced in the seventh practical example will be described.

When only some of a plurality of circularly polarized antenna elements 51 constituting one sequential array are used, an effect sufficient to improve an axial ratio is not obtained. In the seventh practical example, since selected m number of circularly polarized antenna elements 51 constitute one or a plurality of sequential arrays, an effect sufficient to improve an axial ratio can be obtained. Furthermore, since m number of circularly polarized antenna elements 51 are selected in order that the number of necessary first amplifiers 24 is a minimum, power consumption can be reduced.

The above-described practical examples are illustrative, and it goes without saying that configurations described in different practical examples can be partially replaced or combined. Similar function effects achieved by similar configurations in practical examples are not repeatedly described in each practical example. Furthermore, the present invention is not to be limited to the above-described practical examples. For example, it will be obvious to those skilled in the art that various changes, improvements, combinations, and so forth are possible.

While embodiments of the disclosure have been described above, it is to be understood that variations and modifications will be apparent to those skilled in the art without departing from the scope and spirit of the invention. The scope of the invention, therefore, is to be determined solely by the following claims.

What is claimed is:

1. An antenna module comprising:

a plurality of segments each including one input-output port and a plurality of antenna ports and each configured to amplify a radio-frequency signal; and a plurality of subarray antennas each including a plurality of circularly polarized antenna elements, wherein each of the plurality of circularly polarized antenna elements is connected to any of the plurality of antenna ports, the plurality of circularly polarized antenna elements included in each of the plurality of subarray antennas constitutes a sequential array for each subarray antenna, each of the plurality of segments includes a distribution-combination circuit configured to distribute a signal that is input to a first port of the distribution-combination circuit to the plurality of antenna ports via a plurality of second ports of the distribution-combination circuit and configured to combine signals input to the respective plurality of antenna ports so as to output a combined signal from the first port, and a first amplifier connected between the one input-output port and the first port, and a plurality of second amplifiers, at least one of the plurality of second amplifiers disposed along a signal flow path between one of the plurality of antenna ports and a corresponding one of the plurality of second ports of the distribution-combination circuit, wherein, in any one subarray antenna of the plurality of subarray antennas, the plurality of antenna ports to which the respective plurality of circularly polarized antenna elements included in one subarray antenna are connected are included in one segment.

2. The antenna module according to claim 1, further comprising a second amplifier connected between each of the plurality of antenna ports and the distribution-combination circuit.

3. The antenna module according to claim 1, wherein, in any one subarray antenna of the plurality of subarray antennas, under a condition geometric centers of all circularly polarized antenna elements included in one subarray antenna are connected by line segments that are one fewer in number than a number of the circularly polarized antenna elements so that a total length of the line segments is shortest, a length of each of the line segments is not greater than a free-space wavelength corresponding to a resonant frequency of the circularly polarized antenna elements.

4. The antenna module according to claim 2, wherein, in any one subarray antenna of the plurality of subarray antennas, under a condition geometric centers of all circularly polarized antenna elements included in one subarray antenna are connected by line segments that are one fewer in number than a number of the circularly polarized antenna elements so that a total length of the line segments is shortest, a length of each of the line segments is not greater than a free-space wavelength corresponding to a resonant frequency of the circularly polarized antenna elements.

5. The antenna module according to claim 1, wherein, under a condition geometric centers of all the circularly polarized antenna elements are connected by line segments that are one fewer in number than a number of the circularly polarized antenna elements so that a total length of the line segments is shortest, a length of each of the line segments is not greater than a free-space wavelength corresponding to a resonant frequency of the circularly polarized antenna elements.

6. The antenna module according to claim 2, wherein, under a condition geometric centers of all the circularly polarized antenna elements are connected by line segments that are one fewer in number than a number of the circularly polarized antenna elements so that a total length of the line segments is shortest, a length of each of the line segments is not greater than a free-space wavelength corresponding to a resonant frequency of the circularly polarized antenna elements.

7. The antenna module according to claim 3, wherein, under a condition geometric centers of all the circularly polarized antenna elements are connected by line segments that are one fewer in number than a number of the circularly polarized antenna elements so that a total length of the line segments is shortest, a length of each of the line segments is not greater than a free-space wavelength corresponding to a resonant frequency of the circularly polarized antenna elements.

8. The antenna module according to claim 1, wherein each of the plurality of circularly polarized antenna elements has two feeding points, and a plurality of transmission lines are each connected to the two feeding points of the circularly polarized antenna element through a hybrid circuit.

9. The antenna module according to claim 2, wherein each of the plurality of circularly polarized antenna elements has two feeding points, and a plurality of transmission lines are each connected to the two feeding points of the circularly polarized antenna element through a hybrid circuit.

10. The antenna module according to claim 3, wherein each of the plurality of circularly polarized antenna elements has two feeding points, and a plurality of transmission lines are each connected to the two feeding points of the circularly polarized antenna element through a hybrid circuit.

11. The antenna module according to claim 4, wherein each of the plurality of circularly polarized antenna elements has two feeding points, and a plurality of transmission lines are each connected to the two feeding points of the circularly polarized antenna element through a hybrid circuit.

12. The antenna module according to claim 8, wherein each of the plurality of circularly polarized antenna elements overlaps the hybrid circuit when viewed in plan.

13. The antenna module according to claim 12, wherein each of the plurality of circularly polarized antenna elements is circular in shape when viewed in plan.

14. The antenna module according to claim 1, wherein each of the plurality of circularly polarized antenna elements is a perturbation element.

15. The antenna module according to claim 2, wherein each of the plurality of circularly polarized antenna elements is a perturbation element.

16. The antenna module according to claim 1, wherein a direction in which some subarray antennas of the plurality of subarray antennas face differs from a direction in which at least some other subarray antennas face.

17. The antenna module according to claim 2, wherein a direction in which some subarray antennas of the plurality of subarray antennas face differs from a direction in which at least some other subarray antennas face.

18. The antenna module according to claim 1, wherein, in the plurality of subarray antennas, there coexist subarray antennas including respective different numbers of circularly polarized antenna elements constituting a sequential array.

19. The antenna module according to claim 2, wherein, in the plurality of subarray antennas, there coexist subarray antennas including respective different numbers of circularly polarized antenna elements constituting a sequential array.

20. An antenna driving method comprising:

in an antenna module, configured to cause M circularly polarized antenna elements to operate with a plurality of first amplifiers, selecting m circularly polarized antenna elements smaller in number than M and causing the in circularly polarized antenna elements to operate as an active element, causing with any one of the plurality of first amplifiers, among the M number of circularly polarized antenna elements, a plurality of circularly polarized antenna elements to operate, wherein the M number of circularly polarized antenna elements constitute a plurality of sequential arrays, and the causing is performed under conditions of:

selected of the m circularly polarized antenna elements constitute one or a plurality of sequential arrays, and a number of first amplifiers that cause the m circularly polarized antenna elements to operate is a minimum, the m circularly polarized antenna elements being selected from among the M number of circularly polarized antenna elements, and the selected m circularly polarized antenna elements are caused to operate.

* * * * *